US007532315B2

(12) United States Patent
Song

(10) Patent No.: US 7,532,315 B2
(45) Date of Patent: May 12, 2009

(54) AUTOMATIC LENS BLOCKING APPARATUS

(75) Inventor: Joon-Seok Song, Gyeonggi-Do (KR)

(73) Assignee: Huvitz Co., Ltd., Gyeonggi-Do (KR)

( * ) Notice: Subject to any disclaimer, the term of this patent is extended or adjusted under 35 U.S.C. 154(b) by 21 days.

(21) Appl. No.: 11/999,418

(22) Filed: Dec. 5, 2007

(65) Prior Publication Data

US 2008/0160889 A1 Jul. 3, 2008

(30) Foreign Application Priority Data

Dec. 28, 2006 (KR) ..... 10-2006-0136355

(51) Int. Cl.
*G01B 9/00* (2006.01)

(52) U.S. Cl. ..... 356/124; 356/127

(58) Field of Classification Search ..... None
See application file for complete search history.

(56) References Cited

U.S. PATENT DOCUMENTS 5,331,394 A * 7/1994 Shalon et al. ..... 356/124
5,521,700 A * 5/1996 Kajino et al. ..... 356/124
5,523,836 A * 6/1996 Minix ..... 356/124
5,855,074 A * 1/1999 Abitbol et al. ..... 33/507
2005/0237513 A1* 10/2005 Hayashi et al. ..... 356/124

* cited by examiner

*Primary Examiner*—Michael P Stafira
(74) *Attorney, Agent, or Firm*—Blakely, Sokoloff, Taylor & Zafman LLP

(57) ABSTRACT

An automatic lens blocking apparatus having a tracer and a lensmeter therein, for adhering a block to a lens by using a robot arm, is disclosed. The automatic lens blocking apparatus comprises: a tracer for obtaining data on a shape of a glass frame and data on a center of the glass frame; a lensmeter for obtaining data on an optical center of a blank lens by measuring physical property of the blank lens; an image camera part for obtaining an image of a shape and a position of the blank lens; and a blocker (a) for determining a blocking position to which a block is adhered on the basis of (i) the data on the shape of the glass frame and the data on the center of the glass frame obtained from the tracer, (ii) the data on the optical center of the blank lens and physical property of the blank lens obtained from the lensmeter and (iii) the image of the shape and the position of the blank lens obtained from the image camera part, (b) for moving the block and (c) for adhering the block to the blank lens.

8 Claims, 5 Drawing Sheets

AUTOMATIC LENS BLOCKING APPARATUS

This application claims the priority benefit of Korean Patent Application No. 10-2006-0136355 filed on Dec. 28, 2006. All disclosure of the Korean Patent application is incorporated herein by reference.

FIELD OF THE INVENTION

This invention relates to a lens blocking apparatus, and more particularly to, an automatic lens blocking apparatus having a tracer and a lensmeter therein, for adhering a block to a lens by using a robot arm.

BACKGROUNDS OF THE INVENTION

Eye glasses are manufactured by inserting glass lens into a glass frame. The glass lens is selected according to a user's eyesight and the glass frame is selected according to the user's taste. In manufacturing the eye glasses, a blank lens of a circular shape is grinded to be suitable for the glass frame and then the grinded surface of the lens is polished. For these, a tracer, a blocker and a lens edger etc. are used. The tracer is for reading the contour of the glass frame, and the lens edger is for grinding the blank lens to be suitable for the shape of the glass frame. For grinding the blank lens with the lens edger, the blank lens must be firmly fixed to the lens edger so as to prevent the sliding of the blank lens during the lens grinding process. Accordingly, a block, which works as a double-faced tape, is adhered to the blank lens for fixing the blank lens to the lens edger through the block. According to the process type of the lens edger, the block can be adhered to an optical center of the blank lens or can be adhered to a location corresponding to the center of the glass frame.

A lens blocking apparatus (a lens blocker) for adhering the block can be classified into a manual lens blocking apparatus, a semi-automatic lens blocking apparatus and an automatic lens blocking apparatus. In operating the manual lens blocking apparatus, an operator marks an optical center of a blank lens on the surface of the blank lens by using a lensmeter. Then, the operator arranges the optical center of the blank lens and the block, or arranges the location corresponding to the center of the glass frame and the block, while observing through a viewing window which is mounted on the lens blocking apparatus. Thereafter, a block holder on which the block is mounted is allowed to move downwardly to adhere the block to the lens surface. In operating the semi-automatic lens blocking apparatus, the operator marks an optical center of a blank lens on the surface of the blank lens by using a lensmeter. Then, the marked lens is located on a lens supporter of the lens blocking apparatus, and the lens supporter is manually moved to a position at which the blocking process is performed. In the semi-automatic lens blocking apparatus, the blocking process is performed only at the one position. On the other hand, the automatic lens blocking apparatus have a lensmeter and an image processing part therein. Thus, when a blank lens is placed on a lens supporter, the optical center of the lens is automatically searched and then blocking process is performed on the optical center of the blank lens or on the location of the blank lens corresponding to the center of the glass frame. In the manual lens blocking apparatus, all operations are manually performed while observing through the viewing window, and the precision of the blocking process depends on the operator's skill or mistake. In the semi-automatic lens blocking apparatus, the blocking operation is automatically performed, and the precision of the blocking process less depends on the operator's skill or mistake. However, since the optical center of the lens is manually moved for the blocking process, the operator's skill or mistake still affect the performance of the blocking process.

SUMMARY OF THE INVENTION

An object of the present invention is to provide an automatic lens blocking apparatus for preventing the operator's mistake and an operation error thereby.

Yet another object of the present invention is to provide an automatic lens blocking apparatus for improving the operation efficiency and for reducing the operation time by effectively integrating the functions of a lensmeter, a tracer and a blocker therein.

Still yet another object of the present invention is to provide an automatic lens blocking apparatus having structurally efficient mechanism for blocking process.

In order to achieve theses objects of the present invention, it is provided an automatic lens blocking apparatus. The automatic lens blocking apparatus comprises a tracer for obtaining data on a shape of a glass frame and data on a center of the glass frame; a lensmeter for obtaining data on an optical center of a blank lens by measuring physical property of the blank lens; an image camera part for obtaining an image of a shape and a position of the blank lens; and a blocker (a) for determining a blocking position to which a block is adhered on the basis of (i) the data on the shape of the glass frame and the data on the center of the glass frame obtained from the tracer, (ii) the data on the optical center of the blank lens and physical property of the blank lens obtained from the lensmeter and (iii) image of shape and position of the blank lens obtained from the image camera part, (b) for moving the block and (c) for adhering the block to the blank lens. Preferably, the lensmeter and the image camera part are alternately placed on the path of a measuring light passing the blank lens.

DETAILED DESCRIPTION OF THE INVENTION

Hereinafter, the present invention will be described in detail with reference to the accompanying drawings.

Figure 1A:
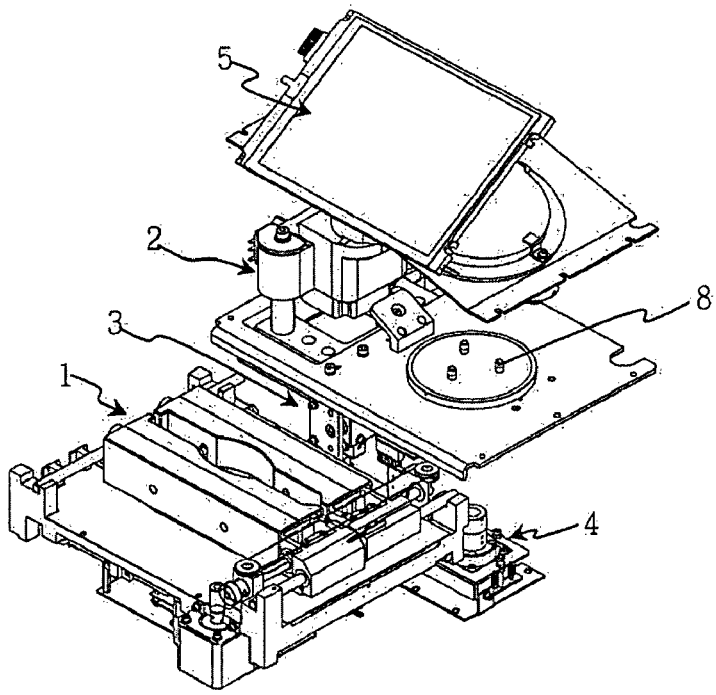
FIGS. 1*a*, 1*b* and 1*c* are respectively a perspective view, a front view and a right-side view of the automatic lens blocking apparatus according to one embodiment of the present invention.
Figure 1B:
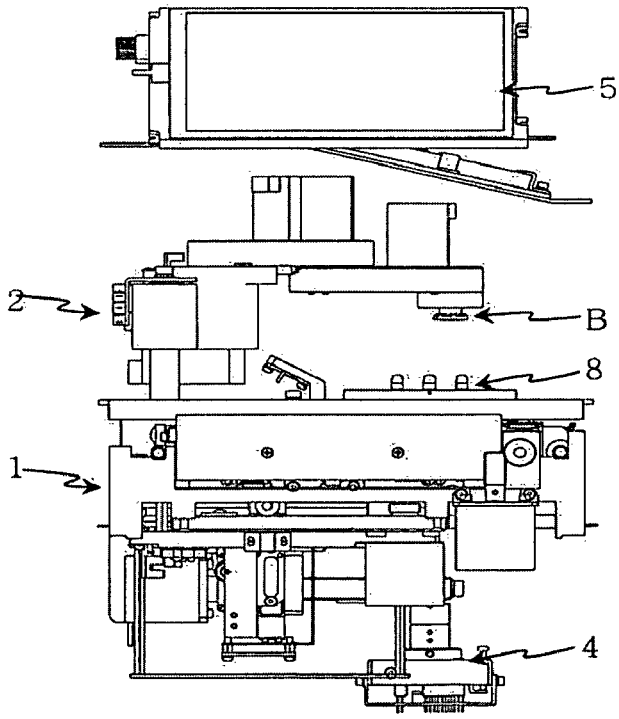
Figure 1C:
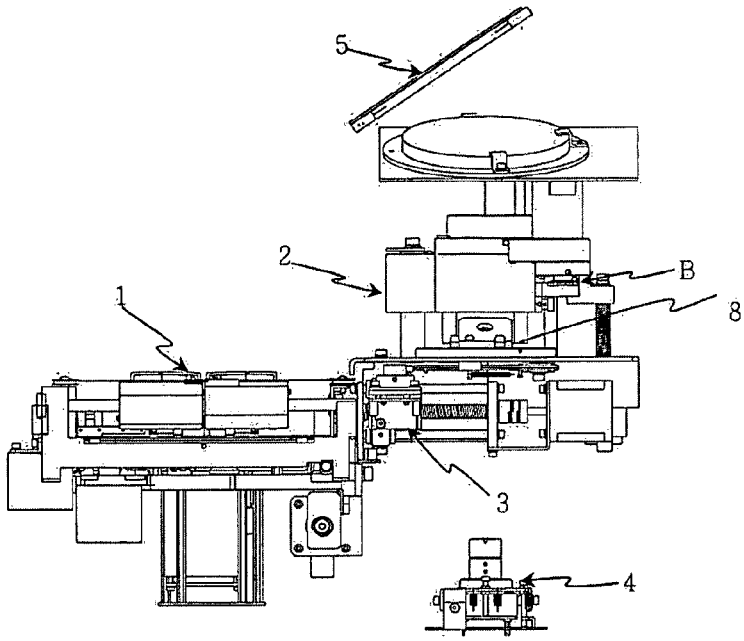

FIG. 1*a*, FIG. 1*b* and FIG. 1*c* show the mechanical parts of the automatic lens blocking apparatus according to one embodiment of the present invention without a controlling section, and are respectively a perspective view, a front view and a right-side view of the automatic lens blocking apparatus. As shown in FIG. 1*a* through 1*c*, the automatic lens blocking apparatus of the present invention includes a tracer 1, a blocker 2, a lensmeter 3, an image camera part 4 and a display section 5. The tracer 1 is to obtain data on the shape of the glass frame selected by a user and data on the center thereof. When the glass frame is placed in the tracer 1, a stylus (not shown) of the tracer 1 traces the track of the glass frame to produce data on the shape of the glass frame and data on the center thereof. The lensmeter 3 measures physical property of the blank lens such as an optical power and a cylinder value of the blank lens to obtain data on an optical center of the blank lens. The image camera part 4 is for achieving image of shape and position of the blank lens. The blocker 2 determines a position to which the block (B, see FIG. 1*b*) is adhere on the basis of (i) the data on the shape of the glass frame and the data on the center thereof obtained by the tracer 1, (ii) physical property of blank lens and the data on optical center position of the blank lens obtained by the lensmeter 3, and (iii) the image data of the shape and position of the blank lens obtained by the image camera part 4. Then the blocker 2 shifts the block B and sticks the block B to the surface of the blank lens placed on the lens supporter 8. The display section 5 is for inputting data or displaying the operation status of the tracer 1, the blocker 2, the lensmeter 3 and the image camera part 4, and is preferably a LCD panel having a touch screen function, and can be used optionally.

Figure 2A:
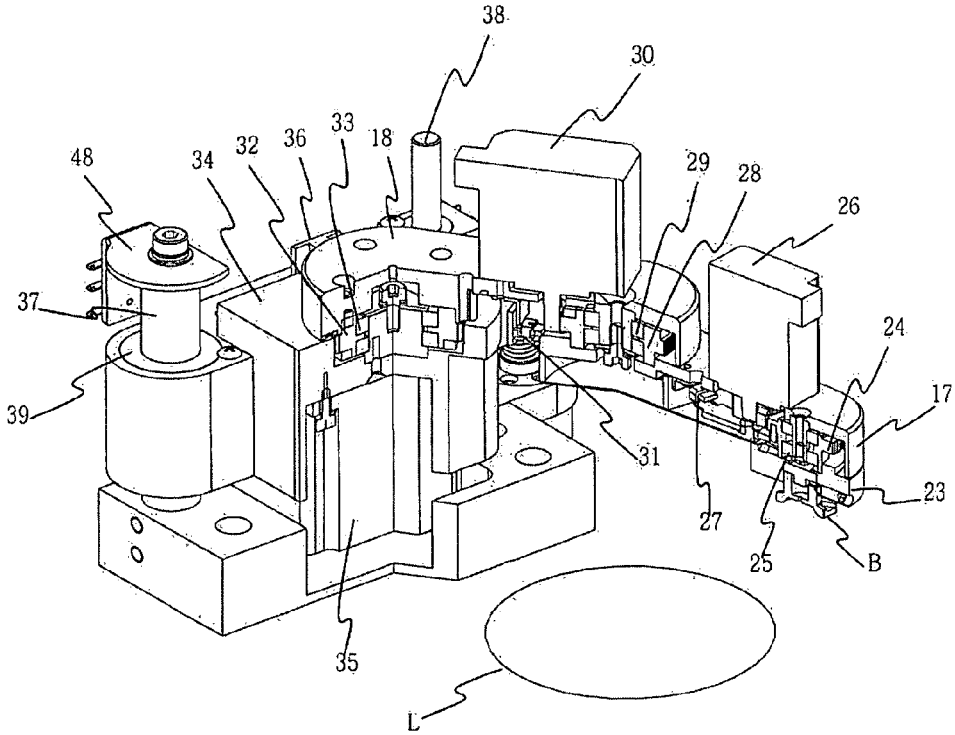
FIG. 2*a* is a partially sectional perspective view of the blocker used in the automatic lens blocking apparatus according to one embodiment of the present invention.
Figure 2B:
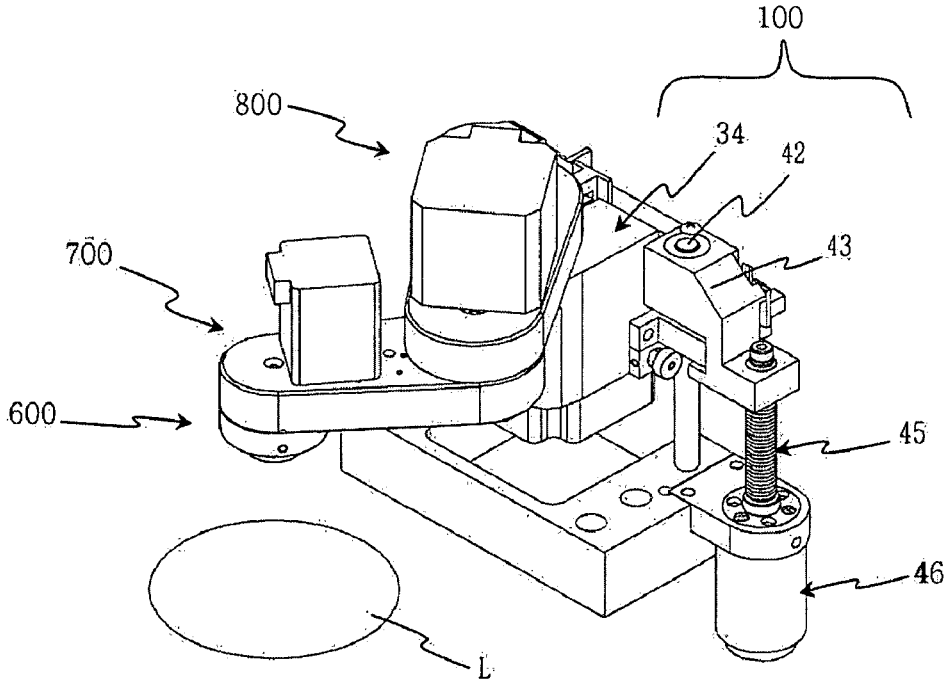
FIG. 2*b* and FIG. 2*c* are rear perspective views of the blocker seen at different angles, the blocker being used in the automatic lens blocking apparatus according to one embodiment of the present invention.
Figure 2C:
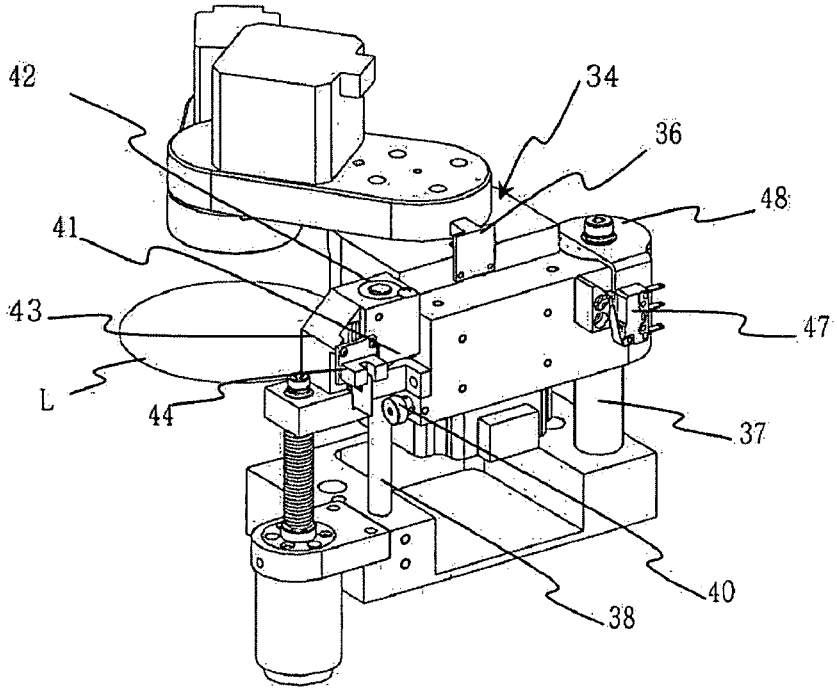

FIG. 2*a* is a partially sectional perspective view of the blocker used in the automatic lens blocking apparatus according to one embodiment of the present invention. FIG. 2*b* and FIG. 2*c* are rear perspective views of the blocker of FIG. 2*a*, seen at different angles. As shown in FIG. 2*a* through 2*c*, the blocker 2 of the present invention has a horizontal multi-joint robot arm. Specifically, the blocker 2 includes a θ-axis rotating section 600, on which the block B is mounted, for rotating the mounted block B by 360 degree, the first pivot rotating section 700 and the second pivot rotating section 800 which pivotally rotates in horizontal direction to move the block B to the blocking position, and a z-axis shifting section 100 for moving the block B in vertically upward and downward direction.

The θ-axis rotating section 600 rotates the block B at need, and is connected to one end of the first pivot rotating section 700, more specifically, is connected to the first arm 17 of the first pivot rotating section 700. The θ-axis rotating section 600 includes a block holder 23 to which the block B is mounted, a gear 24 for rotating the block holder 23, two bearings 25 for rotatably supporting the gear 24, a step motor 26 for driving the gear 24 and a sensor 27 for detecting the initial position of the block holder 23. The first pivot rotating section 700 is connected to one end of the second pivot rotating section 800, and pivotally rotates in the horizontal direction. The first pivot rotating section 700 includes a first arm 17, a gear 28 connected to the first arm 17 for rotating the first arm 17, two bearings 29 for rotatably supporting the gear 28, a step motor 30 for driving the gear 28 and mounted on a second arm 18 of the second pivot rotating section 800 and a sensor 31 for detecting the initial position of the first arm 17. The second pivot rotating section 800 is connected to the z-axis shifting section 100, and pivotally rotates in the horizontal direction. The second pivot rotating section 800 includes the second arm 18, a gear 32 connected to the second arm 18 for rotating the second arm 18, two bearings 33 for rotatably supporting the gear 32, a step motor 35 which drives the gear 32 and is mounted on a arm base 34 of the z-axis shifting section 100, and a sensor 36 for detecting the initial position of the second arm 18. When the lens L and the block B are arranged in the vertically straight line, namely, when the block B is located above the lens L, the z-axis shifting section 100 moves the θ-axis rotating section 600 and the first and second pivot rotating sections 700, 800 in vertically upward or downward direction to adhere the block B to the lens L. As shown in FIG. 2*b*, the z-axis shifting section 100 includes the arm base 34 to which the second pivot rotating section 800 is mounted, a supporting body 43 for supporting the arm base 34 and having a nut structure at one end of thereof, a screw 45 for moving the supporting body 43 in upward or downward direction by being rotated in the nut structure of the supporting body 43, and a motor 46 for rotating the screw 45. The supporting body 43 is guided so as to move only in the upward or downward direction.

As shown in FIGS. 2*a* and 2*c*, the arm base 34 and/or the supporting body 43 are provided with linear bushes 39, 42 so as to guide the vertical movement of the arm base 34 and/or the supporting body 43. The linear bushes 39, 42 may be mounted on fixed shafts 37, 38. Also, the arm base 34 may be provided with a pair of bearings 40 for further guiding the shafts 37, 38. Preferably, a spring 41 can be mounted between the arm base 34 and the supporting body 43 for a shock absorbing when the block B is contacted with the blank lens L, and a sensor 44 is also mounted for detecting the compression of the spring 41 when the supporting body 43 goes down and a force is applied to the lens L. In addition, preferably, there are provided a limit switch 47 for detecting the re-rising of the arm base 34 after the completion of blocking process, and a stopper 48 for preventing the excessive movement of the arm base 34 in case of the malfunction of the limit switch 47.

Figure 3A:
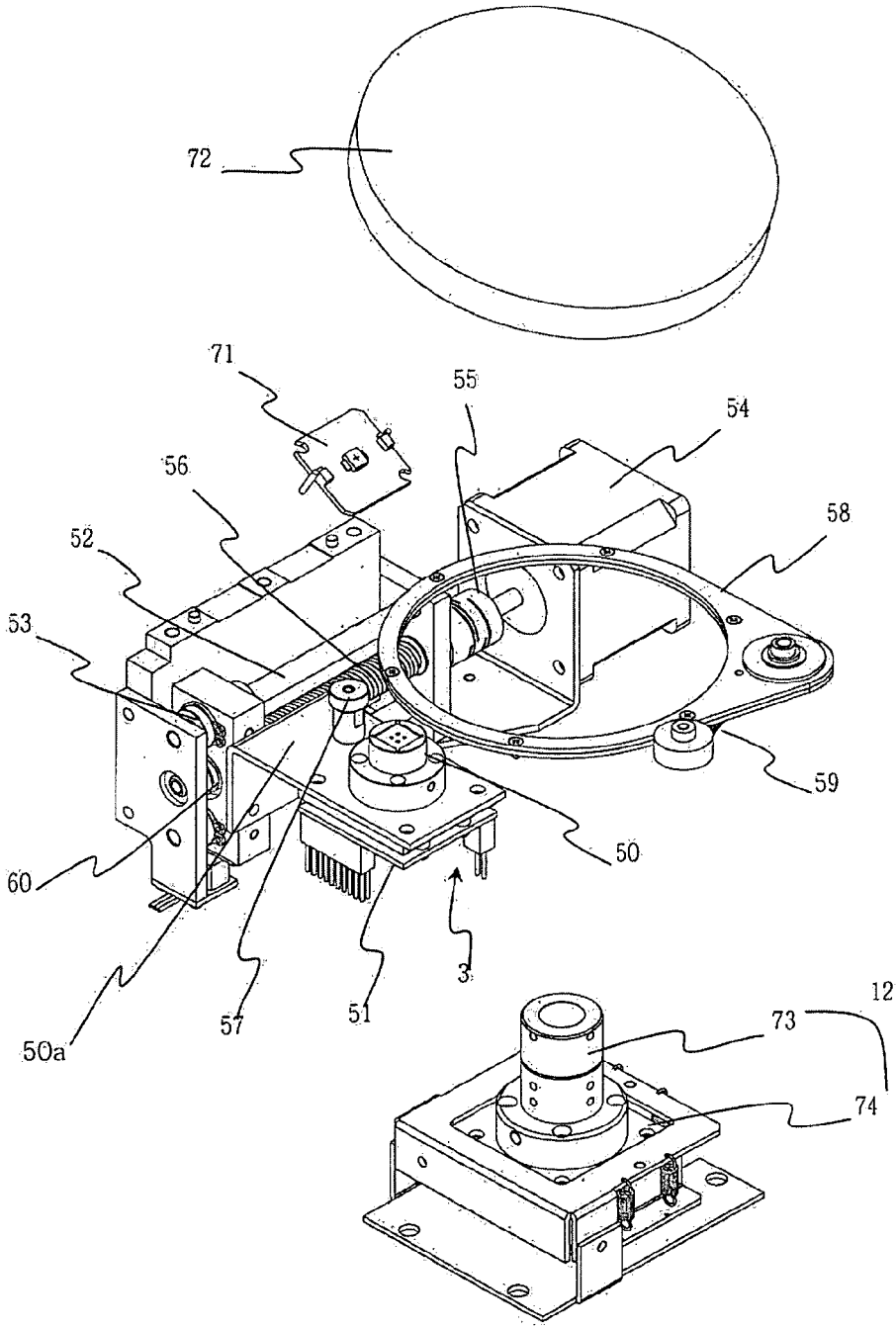
FIG. 3*a* and FIG. 3*b* are perspective views for illustrating the structure and operation of a lensmeter and an image camera part of the automatic lens blocking apparatus according to one embodiment of the present invention.
Figure 3B:
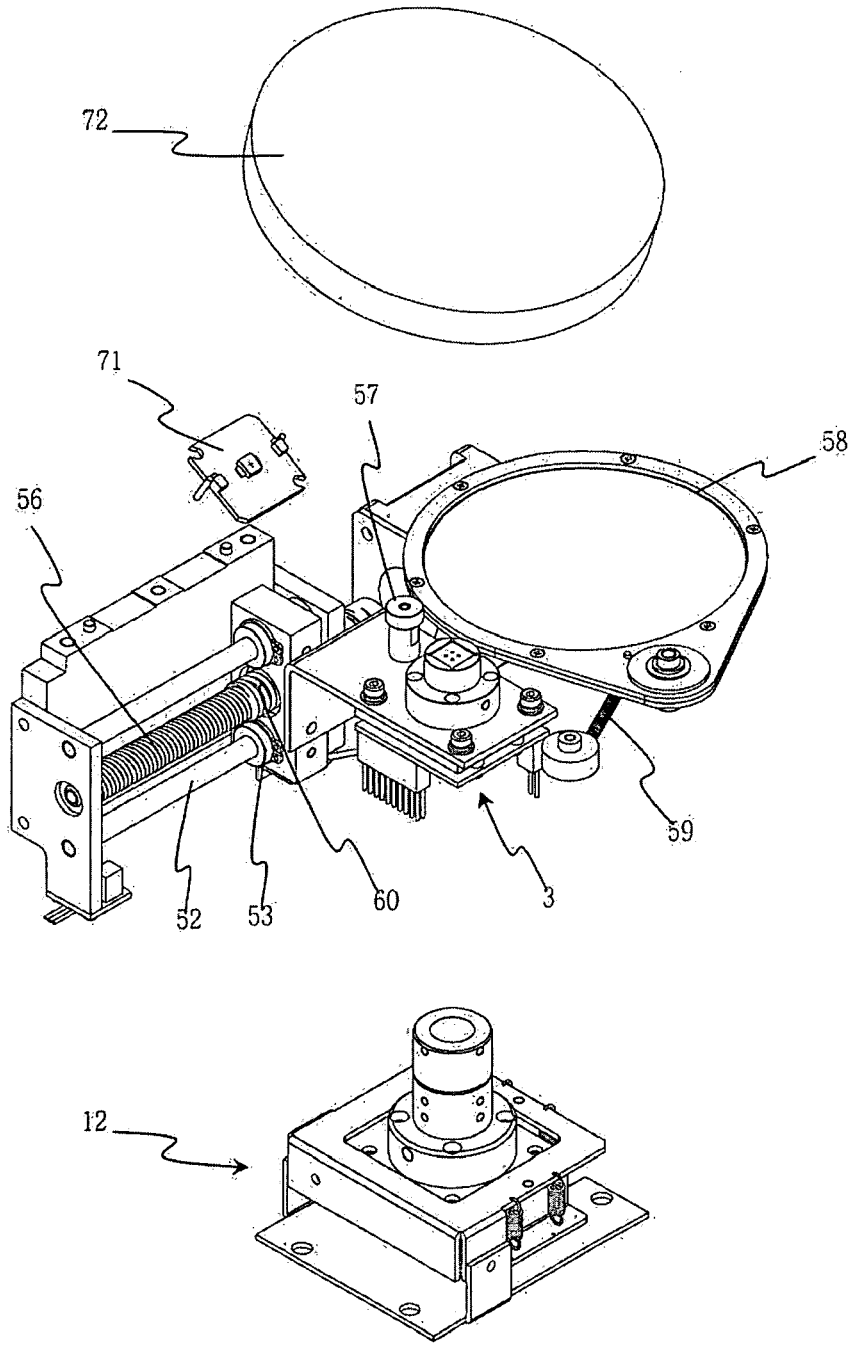

FIG. 3*a* and FIG. 3*b* are perspective views for illustrating the structures and the operations of the lensmeter 3 and the image camera part 4 used in the automatic lens blocking apparatus of the present invention. FIG. 3*a* shows the condition for detecting the shape and the position of a lens and FIG. 3*b* shows the condition for measuring the physical properties including a power value and a cylinder value of the lens and then obtaining the optical center of the lens. As shown in FIG. 3*a* and FIG. 3*b*, the lensmeter 3 includes a lens array 50, a lensmeter camera 51 and a lensmeter base 50*a*. The lens array 50 splits the measuring light, which passes the lens L, to measure the physical properties of the lens. The lensmeter camera 51 detects the split measuring light passes the lens array 50. The lensmeter base 50*a* is provided for mounting the lens array 50 and the lensmeter camera 51, and for moving the lens array 50 and the lensmeter camera 51 to the path of measuring light passing through the lens L. The lensmeter base 50*a* is slidably connected to a screw 56 and is provided with a linear bush 53. The linear bush 53 is slidably mounted on a shaft 52. Accordingly, if a step motor 54 connected to the screw 56 rotates via a coupling 55, the lensmeter base 50*a* moves backwardly or forwardly by the rotation of the screw 56 and the moving track of the lensmeter base 50*a* is safely guided by the shaft 52. For obtaining accurate data, the lensmeter base 50*a* should repeatedly move between two fixed locations. However, since the lensmeter base 50*a* is slidably connected to the screw 56, an error of the movement location may be produced by a back-lash between the lensmeter base 50*a* and the screw 56. Therefore, preferably, both ends of the lensmeter base 50*a* connected to the screw 56 are provided with a compression spring 60. The compression spring 60 always provides a force to the lensmeter base 50*a* which removes the error by the back-lash.

As shown in FIG. 3*a* and FIG. 3*b*, the image camera part 4 is for obtaining the images of the shape and position of the blank lens, and includes a light source 71, a concave lens 72, an image forming plate 58 and a camera 12. The light source 71 irradiates the measuring light to the lens to obtain the shape of lens in form of a shadow thereof, and a light emitting diode can be used as the light source 71. The concave lens 72 converts the measuring light from the light source 71 into a vertical light, and can be used or not used according to the arrangement of the light source 71 and the camera 12. The image forming plate 58 forms an image of the measuring light passing through the lens, that is, the shadow image of the lens. The image forming plate 58 and the lensmeter base 50*a* are alternately located in the path of the measuring light passing the lens. The camera 12 includes a lens array 73 for achieving the lens image formed at the image forming plate 58 and a director 74 such as CMOS etc. The measuring light which is irradiated from the light source 71 and passes the lens, is also used as a light source for detecting the physical properties of the lens with the lensmeter 3. Further, in order to arrange the camera 12 and the central axis of blank lens, the position of the camera 12 can be adjusted.

In the lens blocking apparatus of the present invention, when the lensmeter 3 or the image camera part 4 is working, the lensmeter 3 and the image camera part 4 should be positioned in the line of central axis of the blank lens. Thus, the lensmeter base 50*a* and the image camera part 4 are alternately positioned in the path of the measuring light passing the lens. That is, when measuring the physical properties of the lens, the lensmeter 3 is placed in the line of central axis of the blank lens, i.e. in the progress path of the measuring light. When obtaining the images of the shape and position of the lens, the image forming plate 58 and the camera 12 are placed in the line of central axis of the blank lens, i.e. in the progress path of the measuring light. For these, the image forming plate 58 is pivot-rotatably mounted on the blocking apparatus, and is positioned on the moving path of the lensmeter base 50*a*. Accordingly, when the lensmeter base 50*a* moves to the line of central axis of the blank lens by the rotation of the step motor 54, the lensmeter base 50*a* pushes the image forming plate 58 so that the image forming plate 58 deviates or is separated from the central axis of the blank lens. At this time, if a bearing 57 is mounted on the lensmeter base 50*a* for pushing the image forming plate 58, the image forming plate 58 can be more effectively moved. On the contrary, when the lensmeter base 50*a* deviates from the central axis of the blank lens by the rotation of the step motor 54, the image forming plate 58 returns to the central axis of the blank lens by a restoring force of a spring 59. In detail, one end of the image forming plate 58 is connected to one end of the spring 59 and the other end of the spring 59 is fixed to the blocker so that the spring 59 pulls the image forming plate 58. Therefore, the image forming plate 58 can be restored to the central axis of the blank lens by the restoring force of the spring 59.

Next, referring to FIG. 1*a*, FIG. 3*a* and FIG. 3*b*, the operation of the automatic lens blocking apparatus of the present invention will be explained. Firstly, the data on the shape of a glass frame is obtained with the tracer 1 which is integrated within the automatic lens blocking apparatus. The data on the shape of a glass frame obtained from the tracer 1 is transmitted to a controlling section (not shown) and the image of the glass frame is displayed on a screen of the displaying section 5.

Next, the operator places the blank lens L for adjusting the eyesight of a user on the lens supporter 8. At this time, since the image of the blank lens L is displayed at the displaying section 5, the operator can roughly place the blank lens L on the center of the lens supporter 8 with reference to the image of the display section 5. Thereafter, information required for the lens processing is inputted by using a touch-screen function of the display section 5 or another input button (not shown) and then the blocking process is performed. In the blocking process, the step motor 54 is operated to shift the lensmeter 3 to the line of central axis of lens supporter 3 in order to obtain the optical center of the blank lens L. At this time, the image forming plate 58 is pushed by the bearing 57 mounted on the lensmeter 3 and is automatically deviated from the line of central axis of the lens L. Next, the physical properties (the power value, the cylinder value etc.) of the blank lens L are measured and the optical center of the blank lens L is obtained by the lensmeter 3. The data of physical properties and the optical center of the blank lens L, which is obtained from the lensmeter 3, are transmitted to the controlling section (not shown). Then the step motor 54 is again operated and the lensmeter 3 is returned to its original position. At this time, the image forming plate 58 automatically returns to the line of central axis of the lens L by the spring 59, and the shape and the present position of the blank lens L are displayed at the displaying section 5 and transmitted to the controlling section (not shown). The controlling section (not shown) determines a blocking position on the basis of the data on the shape and position of the blank lens, the data on the physical properties of the blank lens, the data on the shape and central position of the glass frame, and other lens processing information inputted by the operator, and the calculated blocking position is displayed on the displaying section 5. The operator drives the blocker 2 to adhere the block B to the blank lens L after confirming the calculated blocking position at the display section 5.

Returning to FIG. 2*a*~2*c*, the operation of the blocker 2 will be described in detail. The controlling section (not shown) transmits data values for driving the step motors 26, 30, 35 by which the θ-axis rotating section 600 and the first and second pivot rotating sections 700, 800 are drived. After, the step motors 26, 30, 35 operate, the motor of the Z-axis shifting section 100 operates so that the θ-axis rotating section 600, the first and second pivot rotating sections 700, 800 and Z-axis shifting section 100 move downwardly to adhere the block B to the blank lens L. When the block begins to contact with the blank lens L, the spring 41 of the Z-axis shifting section 100 is compressed and the compression of the spring 41 is detected by the sensor 44. If the compression of the spring 41 is detected, the driving direction of the motor 46 is changed to move θ-axis rotating section 600, the first and second pivot rotating sections 700, 800 and Z-axis shifting section 100 upwardly. When the rising of the Z-axis shifting section 100 is detected by the limit switch 47, the motor 46 stops and the up-and-down movement of the θ-axis rotating section 600, the first and second pivot rotating sections 700, 800 and Z-axis shifting section 100 is finished. Thereafter, if necessary, θ-axis rotating section 600, the first and second pivot rotating sections 700, 800 and Z-axis shifting section 100 are returned to their original positions. Next, the lens L to which the block B is adhered is grinded with the lens edger to fit for the glass frame.

As described above, the automatic lens blocking apparatus of the present invention effectively integrates the functions of a lensmeter, a tracer and a blocker, and prevents an operating error which results from the operator's mistake.

The invention claimed is:

1. An automatic lens blocking apparatus comprising:

a tracer for obtaining data on a shape of a glass frame and data on a center of the glass frame;

a lensmeter for obtaining data on an optical center of a blank lens by measuring physical property of the blank lens;

an image camera part for obtaining an image of a shape and a position of the blank lens; and a blocker (a) for determining a blocking position to which a block is adhered on the basis of (i) the data on the shape of the glass frame and the data on the center of the glass frame obtained from the tracer, (ii) the data on the optical center of the blank lens and physical property of the blank lens obtained from the lensmeter and (iii) the image of the shape and the position of the blank lens obtained from the image camera part, (b) for moving the block and (c) for adhering the block to the blank lens.

2. The automatic lens blocking apparatus of claim 1, wherein the blocker has a horizontal multi-joint robot arm.

3. The automatic lens blocking apparatus of claim 1, wherein the blocker includes:

a θ-axis rotating section, on which the block is mounted, for rotating the mounted block;

a first pivot rotating section which is connected to the θ-axis rotating section and pivotally rotates in horizontal direction;

a second pivot rotating section which is connected to the first pivot rotating section and pivotally rotates in horizontal direction; and a z-axis shifting section which is connected to the second pivot rotating section and moves in vertically upward and downward direction together with the θ-axis rotating section, the first pivot rotating section and the second pivot rotating section.

4. The automatic lens blocking apparatus of claim 1, wherein the lensmeter and the image camera part are alternately placed on the path of a measuring light passing the blank lens.

5. The automatic lens blocking apparatus of claim 4, wherein the lensmeter includes:

a lens array which splits the measuring light passing the blank lens, to measure the physical properties of the blank lens;

a lensmeter camera which detects the split measuring light; and a lensmeter base for mounting the lens array and the lensmeter camera and for moving the lens array and the lensmeter camera to the path of the measuring light passing the lens.

6. The automatic lens blocking apparatus of claim 5, wherein the image camera part includes:

a light source which irradiates the measuring light to the blank lens to obtain the shape of the blank lens;

an image forming plate which forms an image of the measuring light passing the lens, wherein the image forming plate and the lensmeter base are alternately located in the path of the measuring light passing the lens; and a camera for obtaining the lens image formed at the image forming plate.

7. The automatic lens blocking apparatus of claim 6, wherein the image forming plate is pivot-rotatably mounted on the blocker and is positioned on the moving path of the lensmeter base.

8. The automatic lens blocking apparatus of claim 5, wherein the lensmeter base is slidably connected to a screw, and moves backwardly or forwardly by the rotation of the screw, and both ends of the lensmeter base are provided with a compression spring for providing a force to the lensmeter base which removes the error by a back-lash.

* * * * *